US010648145B2

(12) United States Patent
Zhou et al.

(10) Patent No.: US 10,648,145 B2
(45) Date of Patent: May 12, 2020

(54) FLOATING DRILLING PLATFORM FOR OFFSHORE OIL / GAS DRILLING AND EXPLORATION IN ICE-INFESTED POLAR AREAS

(71) Applicant: China Merchants Heavy Industry (Jiangsu) Co., Ltd., Nantong, Jiangsu Province (CN)

(72) Inventors: Zhengquan Zhou, Nantong (CN); Fan Zhang, Nantong (CN); Lixin Xu, Nantong (CN); Mingyuan Sun, Nantong (CN); Jiancheng Liu, Nantong (CN)

(73) Assignee: China Merchants Heavy Industry (Jiangsu) Co., Ltd., Nantong, Jiangsu (CN)

( * ) Notice: Subject to any disclaimer, the term of this patent is extended or adjusted under 35 U.S.C. 154(b) by 0 days.

(21) Appl. No.: 16/240,828

(22) Filed: Jan. 7, 2019

(65) Prior Publication Data

US 2020/0056342 A1 Feb. 20, 2020

(30) Foreign Application Priority Data

Aug. 17, 2018 (CN) ..... 2018 1 0941117

(51) Int. Cl.
*B63B 35/44* (2006.01)
*E02B 17/00* (2006.01)
(Continued)

(52) U.S. Cl.
CPC ..... *E02B 17/0021* (2013.01); *B63B 35/4413* (2013.01); *B63B 35/083* (2013.01);
(Continued)

(58) Field of Classification Search
CPC . B63B 35/4413; B63B 35/44; B63B 2211/06; B63B 35/08; E02B 17/0021;
(Continued)

(56) References Cited

U.S. PATENT DOCUMENTS 4,059,065 A * 11/1977 Clark ..... B65D 88/78 114/256
4,701,075 A * 10/1987 Martyshenko ..... E02B 17/025 405/204

(Continued)

FOREIGN PATENT DOCUMENTS

CN 108995778 A 12/2018

*Primary Examiner* — Carib A Oquendo
(74) *Attorney, Agent, or Firm* — PROI Intellectual Property US

(57) ABSTRACT

A floating drilling platform for offshore oil/gas drilling and exploration in ice-infested polar areas comprises a deck module, a hard compartment, and a soft compartment sequentially connected from top to bottom. The bottom of the deck module is connected to the top of the hard compartment by evenly distributed column. Both the hard and the soft compartments are cylinders centrally arranged with center wells. The deck module is also centrally arranged with a center well. The hard compartment, the soft compartment and the deck module are coincident with a centerline. The outer diameter of the soft compartment, as well as that of the deck module, is larger than that of the hard compartment. The top of the hard compartment is designed with a circular inclined plane upwardly and outwardly arranged at the outer edge. The top of the circular inclined plane is connected to the bottom of the deck module.

7 Claims, 4 Drawing Sheets

(51) Int. Cl.
*B63B 35/08* (2006.01)
*E02B 17/02* (2006.01)

(52) U.S. Cl.
CPC ..... *B63B 2211/06* (2013.01); *E02B 17/027* (2013.01); *E02B 2017/0069* (2013.01)

(58) Field of Classification Search
CPC ..... E02B 2017/0086; E02B 17/027; E02B 2017/0069; E21B 17/012
See application file for complete search history.

(56) References Cited

U.S. PATENT DOCUMENTS

| | | | | |
|---|---|---|---|---|
| 9,415,843 | B1 * | 8/2016 | Vandenworm | B63B 35/4413 |
| 2005/0281623 | A1 * | 12/2005 | Chianis | B63B 9/065 405/223.1 |
| 2009/0126616 | A1 * | 5/2009 | Srinivasan | B63B 35/44 114/264 |
| 2012/0132122 | A1 * | 5/2012 | Vandenworm | B63B 1/041 114/261 |
| 2012/0195690 | A1 * | 8/2012 | Luo | B63B 9/065 405/195.1 |
| 2013/0084136 | A1 * | 4/2013 | Losnedal | E02B 17/00 405/204 |
| 2013/0160693 | A1 * | 6/2013 | Roodenburg | B63B 35/4413 114/265 |
| 2018/0171573 | A1 * | 6/2018 | Krstulovic-Opara | E02B 17/0021 |

* cited by examiner

FLOATING DRILLING PLATFORM FOR OFFSHORE OIL / GAS DRILLING AND EXPLORATION IN ICE-INFESTED POLAR AREAS

TECHNICAL FIELD

This invention relates to the field of offshore oil/gas drilling equipment, particularly to a floating drilling platform for offshore oil/gas drilling and exploration in ice-infested polar areas.

BACKGROUND OF THE INVENTION

The oil and gas exploration in the Arctic region has become increasingly active during past decades. However, the Arctic environment also poses special challenges to the design, fabrication and operation of drilling platforms. Due to the low temperature and ice-infested water conditions, the traditional drilling platforms are operated within a limited window period (about two-months) during the summer season, which leads to a relatively long project period and a higher cost.

Facing the challenges of ice-flows and harsh environment, it is necessary to develop a floating platform with ice resistance capability and outstanding motion performance for operation in ice-infested waters and harsh environment.

SUMMARY OF THE INVENTION

The present invention provides an improved floating drilling platform with ice resistance capability and outstanding motion performance for operation in ice-infested waters and harsh environment. The platform can operate in the middle-scale ice conditions all through the year, which enlarges the operation window period and reduces the project investment.

The technical scheme of this invention is as follows:

A floating drilling platform for offshore oil/gas drilling and exploration in ice-infested polar areas, characterized by comprising a deck module, a hard compartment and a soft compartment sequentially connected from top to bottom;

Wherein, the bottom of the deck module is connected to the top of the hard compartment by evenly distributed columns; both the hard compartment and the soft compartment are cylinders centrally arranged with center wells; the deck module is also centrally arranged with a center well; the hard compartment, the soft compartment and the deck module are coincident with a centerline; the outer diameter of the soft compartment is larger than that of the hard compartment; the outer diameter of the deck module is larger than that of the hard compartment; the top of the hard compartment is designed with a circular inclined plane upwardly and outwardly arranged at the outer edge; the top of the circular inclined plane is connected to the bottom of the deck module;

The soft compartment is internally arranged with plural ballast compartments; the hard compartment is internally arranged with plural void compartments.

The hard compartment provides buoyancy force for the platform, and the soft compartment houses ballast water and oil/gas load, or fixed ballast to lower the height of center of gravity of the platform.

In open waters, the platform is in the normal operation draft condition, the water plane is at the middle of the hard compartment. In ice-infested waters, the platform is in the ice operation draft condition with the water plane located at the circular inclined plane. In extreme environmental conditions, the water plane is located at the lower part of the hard compartment to increase the freeboard of the drilling platform.

Further, the deck module is of upper-end closing type.

Further, a collision bulkhead is arranged outside the wing wall of the hard compartment.

Further, a collision bulkhead is arranged outside the circular inclined plane.

Further, a collision bulkhead is arranged outside the wing wall of the deck module. When the platform is collided with ice sheets, it can be protected by the collision bulkhead.

Further, the cross section of the center well of the deck module, the cross section of the center well of the hard compartment and the cross section of the center well of the soft compartment are of square type.

Further, the size of the center well of the soft compartment is smaller than that of the hard compartment.

Further, the four corners of the center well of the hard compartment are internally arranged with vertical staircase shafts; the bottom of the vertical staircase shafts is closed to avoid contact with seawater; the staircase shafts are communicated with void compartments within the hard compartment.

Further, the marine pipelines for the compartments are arranged within the staircase shafts.

Further, the top of the soft compartment is connected to the hard compartment with an inclined compartment with an inclined plane upwardly and inwardly arranged. The inclined compartment is the transition section between the hard compartment and the soft compartment, which can avoid the transient instability of the platform when the soft compartment is completely immersed in seawater during the installation of the platform.

Further, 8 columns are symmetrically and radially arranged at four top points of the center well and at the top of the outer wall of the hard compartment.

Further, the cross section of the void compartments is of a same sector with unfilled corner.

Further, the floating drilling platform has a mooring cable; the chain of the mooring cable is connected to the top of the hard compartment along the center well through a mooring cable conduit; the cable chock of the mooring cable is mounted outside the soft compartment; the handling unit of the mooring cable is mounted at the top of the hard compartment.

Further, the mooring cable is of chain-cable-chain type which can withstand the large ice load and environmental load.

Further, an anti-collision frame is externally arranged in the middle of the hard compartment; the anti-collision frame consists of an anti-collision ring and plural legs; the anti-collision ring is horizontally arranged with a diameter larger than the outer diameter of the hard compartment; the anti-collision ring is connected to the outer wall of the hard compartment with the legs; the legs are in a "<" shape with a dip angle of 45°. The anti-collision frame is near to the draft when the platform operates in open waters, which can break ice sheet and protect the hard compartment.

Further, the column is 5 m high, which can prevent the surge to deck and support the mass of upper deck module.

Further, the cross section of the deck module is of square type.

Further, the ratio of the diameter of the hard compartment to the length or width of the center well is 1.5-2.5.

Further, the soft compartment is made of general steel.

The main benefits of the proposed drilling platform are summarized as follows:

1. The cylindrical hard compartment can reduce the contact area between the platform and ice flows;
2. The center well houses the drilling riser and shields the riser from ice flows;
3. The large-diameter soft compartment can load a large amount of ballast water, which can lower the height of center of gravity of the platform;
4. The upper-end closed deck module can meet the anti-freezing requirement for operation in ice-infested waters, and provide buoyance force for the platform in emergency; and the upper-end closed deck module can be used to install the drilling rig and other operation equipment;
5. Both the center well and the main body of the soft compartment have a large size, and their relation can be optimized to provide enough stability;
6. The mooring cable is arranged in the center well to avoid collision of ice flows.

Wherein, 1 is the deck module, 2 is the circular inclined plane, 3 is the hard compartment, 4 is the inclined compartment, 5 is the soft compartment, 6 is the center well, 7 is the staircase shaft, 8 is the column, 9 is the collision bulkhead, 10 is the mooring cable, and 11 is the bulkhead.

DETAILED DESCRIPTION OF PREFERRED EMBODIMENT

The technical features and benefits of the present invention will be described as follows in detail in combination with embodiments.

Figure 1:
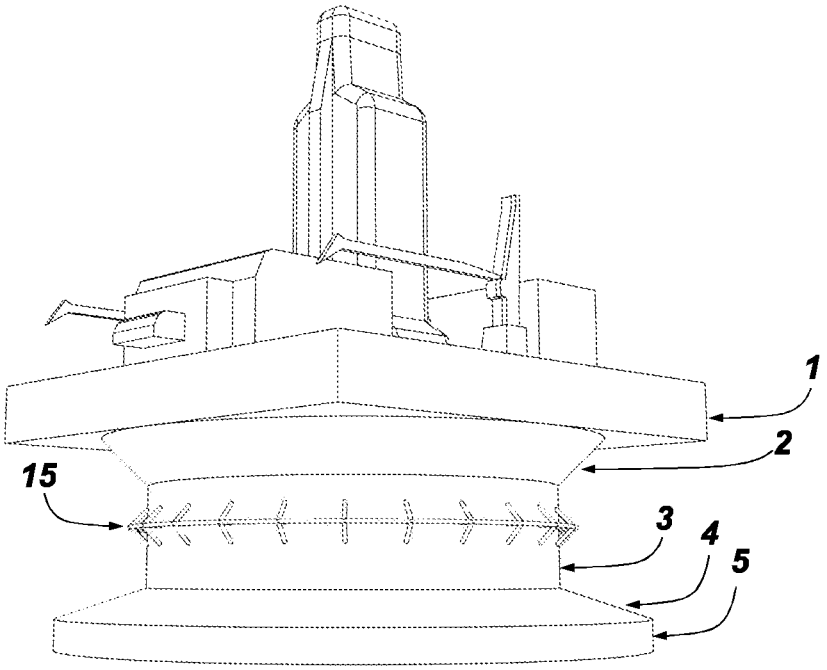
FIG. 1 is a 3D view of the floating drilling platform for offshore oil/gas drilling and exploration in ice-infested polar areas of the present invention.
Figure 2:
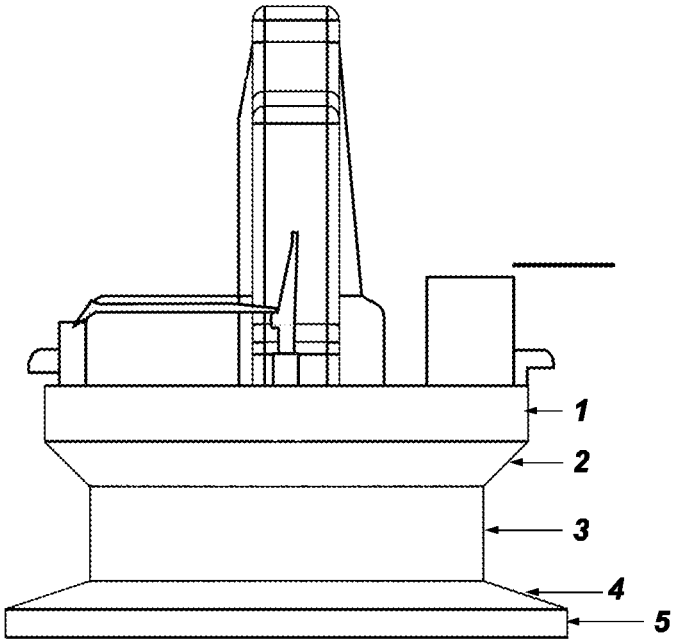
FIG. 2 is a general arrangement of the floating drilling platform for offshore oil/gas drilling and exploration in ice-infested polar areas.
Figure 3:
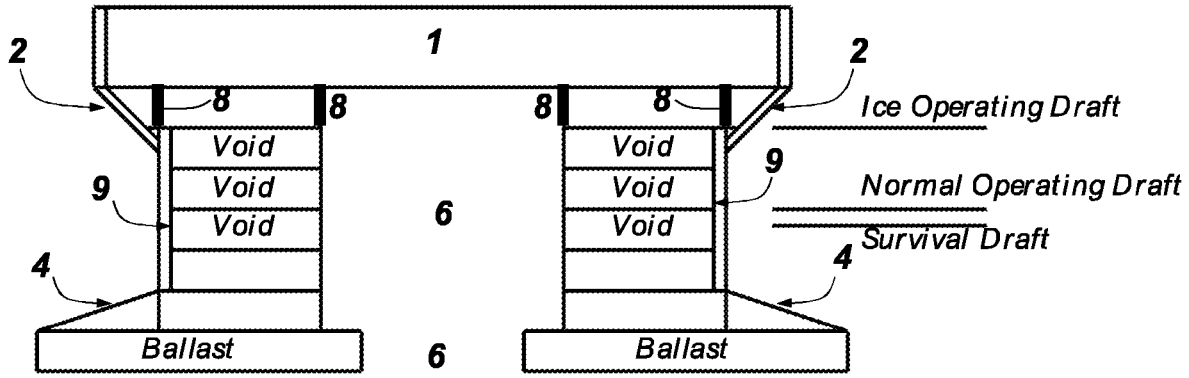
FIG. 3 is a cross-section view of the floating drilling platform for offshore oil/gas drilling and exploration in ice-infested polar areas.
Figure 4:
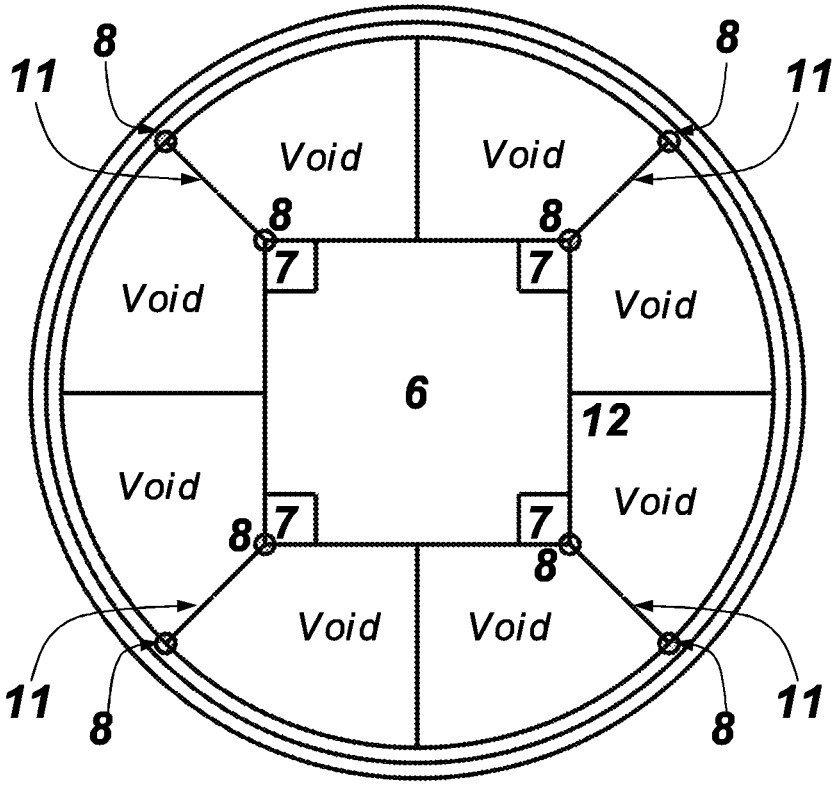
FIG. 4 is a vertical view of the top of the hard compartment.
Figure 5:
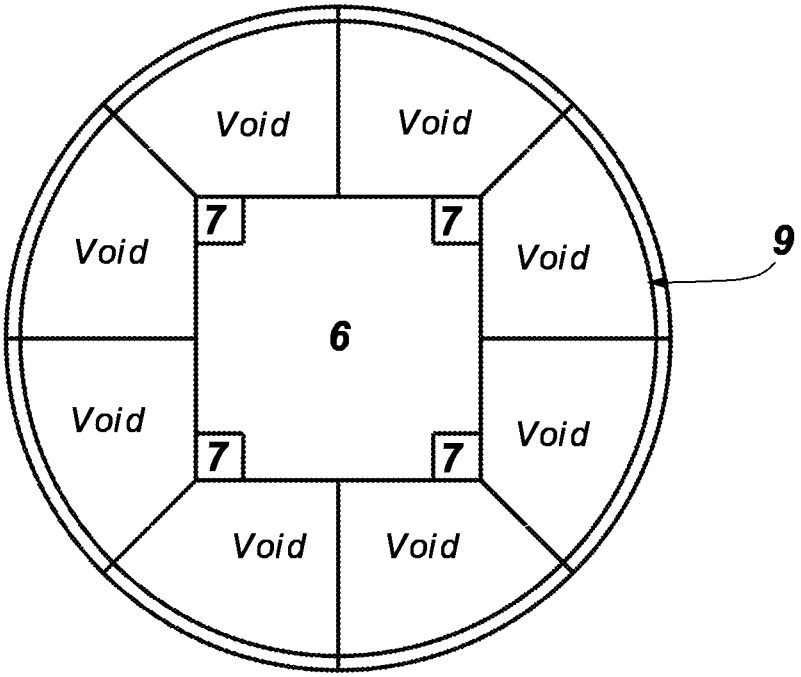
FIG. 5 is a cross-section view of the hard compartment.
Figure 6:
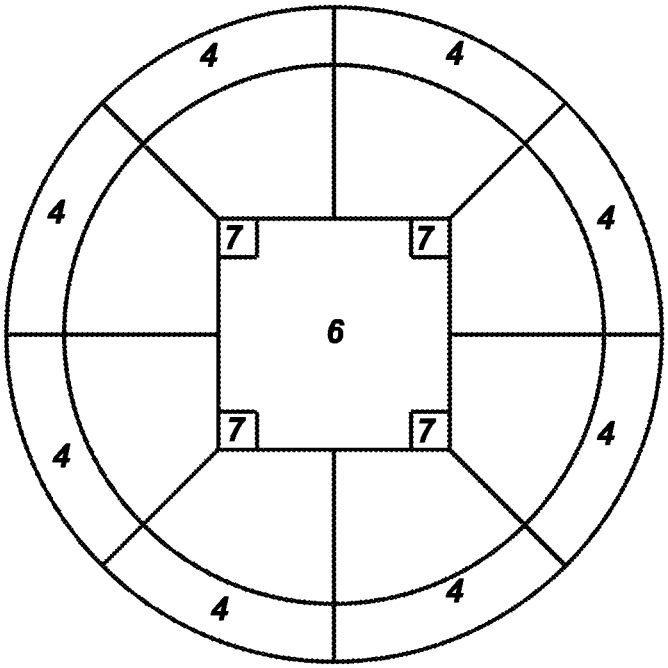
FIG. 6 is a cross-section view of the inclined compartment.
Figure 7:
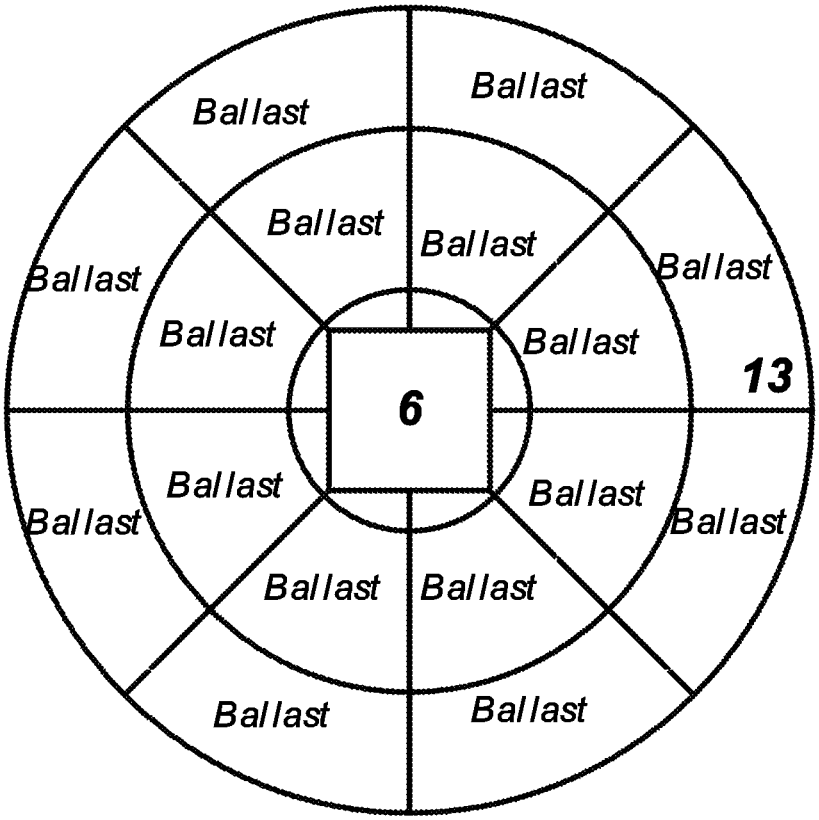
FIG. 7 is a cross-section view of the soft compartment.
Figure 8:
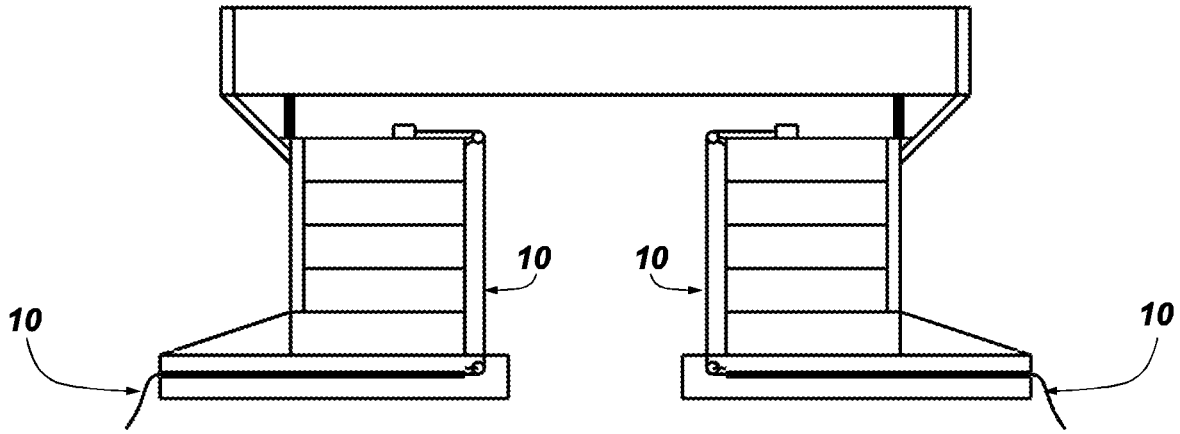
FIG. 8 is an arrangement view of the mooring system.

As shown in FIGS. 1-8, the present invention provides a floating drilling platform for offshore oil/gas drilling and exploration in ice-infested polar areas, comprising a deck module 1, a hard compartment 3 and a soft compartment 5 sequentially connected from top to bottom;

Wherein, the bottom of the deck module 1 is connected to the top of the hard compartment 3 by evenly distributed columns 8; both the hard compartment 3 and the soft compartment 5 are cylinders centrally arranged with center wells 6; the deck module 1 is also centrally arranged with a center well 6; the hard compartment 3, the soft compartment 5 and the deck module 1 are coincident with a centerline; the outer diameter of the soft compartment 5 is larger than that of the hard compartment 3; the outer diameter of the deck module 1 is larger than that of the hard compartment 3; the top of the hard compartment 3 is designed with a circular inclined plane 2 upwardly and outwardly arranged at the outer edge; the top of the circular inclined plane 2 is connected to the bottom of the deck module 1;

The soft compartment 5 is internally arranged with plural ballast compartments; the hard compartment 3 is internally arranged with plural void compartments.

The hard compartment 3 provides buoyance force for the platform.

The soft compartment 5 is designed to provide a space with very large volume to house ballast water, fixed ballast, and oil; the soft compartment 5 with large amount of ballast can lower the height of center of gravity of the platform, maintaining stability for the platform in operations.

In services, the drilling platform has three drafts under different operation conditions. In open waters, the platform is in the normal operation draft condition, the water plane is at the middle of the hard compartment 3. In ice-infested waters, the platform is in the ice operation draft condition with the water plane located at the upper circular inclined plane 2 of the hard compartment 3. In extreme environmental conditions, the platform is in the survival draft condition with the water plane located at the lower part of the hard compartment 3 to increase the freeboard of the drilling platform.

The bottom of the center well 6 is communicated with seawater, and the center well houses the drilling riser and shields the riser from ice flows.

The deck module 1 is of upper-end closing type.

A collision bulkhead 9 is arranged outside the wing wall of the hard compartment 3.

A collision bulkhead 9 is arranged outside the circular inclined plane 2.

A collision bulkhead 9 is arranged outside the wing wall of the deck module 1. When the platform is collided with ice sheets, it can be protected by the collision bulkhead 9.

The cross section of the center well 6 of the deck module 1, the cross section of the center well 6 of the hard compartment 3 and the cross section of the center well 6 of the soft compartment 5 are of square type.

The size of the center well 6 of the soft compartment 5 is smaller than that of the hard compartment 3.

The four corners of the center well 6 of the hard compartment 3 are internally arranged with vertical staircase shafts 7; the bottom of the vertical staircase shafts 7 is closed to avoid contact with seawater; the staircase shafts 7 are communicated with void compartments within the hard compartment 3.

The marine pipelines for the compartments are arranged within the staircase shafts 7.

The top of the soft compartment 5 is connected to the hard compartment 3 with an inclined compartment 4 with an inclined plane upwardly and inwardly arranged. The inclined compartment 4 can avoid the transient instability of the platform when the soft compartment 5 is completely immersed in seawater during the installation of the platform.

The upper circular inclined plane 2 can cause flexural damage to ice sheets so as to achieve the effect of breaking ice.

8 columns 8 are symmetrically and radially arranged at four top points of the center well 6 and at the top of the outer wall of the hard compartment 3.

The cross section of the void compartments is of a same sector with unfilled corner.

The floating drilling platform has a mooring cable 10; the chain of the mooring cable 10 is connected to the top of the hard compartment 3 along the center well 6 through a mooring cable conduit; the cable chock of the mooring cable 10 is mounted outside the soft compartment 5; the handling unit of the mooring cable is mounted at the top of the hard compartment 3.

The mooring cable 10 is of chain-cable-chain type which can withstand the large ice load and environmental load.

An anti-collision frame is externally arranged in the middle of the hard compartment 3; the anti-collision frame consists of an anti-collision ring and plural legs; the anti-collision ring is horizontally arranged with a diameter larger than the outer diameter of the hard compartment 3; the anti-collision ring is connected to the outer wall of the hard compartment 3 with the legs; the legs are in a "<" shape with a dip angle of 45°. The anti-collision frame is near to the draft when the platform operates in open waters, which can break ice sheet and protect the hard compartment 3.

The column 8 is 5 m high, which can prevent the surge to deck and support the mass of upper deck module 1.

The upper circular inclined plane 2 is theoretically proven to be a profile capable of breaking ice.

The ratio of the diameter of the hard compartment 3 to the length or width of the center well 6 is 1.5-2.5.

The soft compartment 5 is made of general steel.

The above description only presents the preferred embodiment of the present invention, not intending to limit its scope. All improvements and changes performed as per the main spirit of the present invention shall fall within the protection scope determined by the claims of the present invention.

What is claimed is:

1. A floating drilling platform for offshore oil/gas drilling and exploration in ice-infested polar areas, comprising a deck module, a first compartment and a second compartment sequentially connected from top to bottom; wherein a bottom of the deck module is connected to a top of the first compartment by evenly distributed columns;

both the first compartment and the second compartment are cylinders centrally arranged with center wells;

the deck module is also centrally arranged with a center well;

the first compartment, the second compartment and the deck module are coincident with a centerline;

an outer diameter of the second compartment is larger than an outer diameter of the first compartment;

an outer diameter of the deck module is larger than an outer diameter of the first compartment;

a top of the first compartment is designed with a circular inclined plane upwardly and outwardly arranged at an outer edge;

a top of the circular inclined plane is connected to the bottom of the deck module;

the second compartment is internally arranged with a plurality of ballast compartments; and the first compartment is internally arranged with a plurality of void compartments;

and wherein a cross section of the center well of the deck module, a cross section of the center well of the first compartment and a cross section of the center well of the second compartment are of square type, and wherein four corners of the center well of the first compartment are internally arranged with vertical staircase shafts, bottom of the vertical staircase shafts is closed to avoid contact with seawater, and the vertical staircase shafts are communicated with void compartments within the first compartment.

2. The floating drilling platform for offshore oil/gas drilling and exploration in ice-infested polar areas according to claim 1, wherein the deck module is of upper-end closing type.

3. The floating drilling platform for offshore oil/gas drilling and exploration in ice-infested polar areas according to claim 1, wherein a collision bulkhead is arranged respectively outside a wing wall of the first compartment, outside the circular inclined plane, and outside a wing wall of the deck module.

4. The floating drilling platform for offshore oil/gas drilling and exploration in ice-infested polar areas according to claim 1, wherein a size of the center well of the second compartment is smaller than that of the first compartment.

5. The floating drilling platform for offshore oil/gas drilling and exploration in ice-infested polar areas according to claim 1, wherein a top of the second compartment is connected to the first compartment with an inclined compartment with an inclined plane upwardly and inwardly arranged.

6. The floating drilling platform for offshore oil/gas drilling and exploration in ice-infested polar areas according to claim 1, wherein eight columns are symmetrically and radially arranged at four top points of the center well and at a top of an outer wall of the first compartment.

7. The floating drilling platform for offshore oil/gas drilling and exploration in ice-infested polar areas according to claim 1, wherein the floating drilling platform has a mooring cable; to chain of the mooring cable is connected to the top of the first compartment along the center well through a mooring cable conduit; a cable chock of the mooring cable is mounted outside the second compartment; a handling unit of the mooring cable is mounted at the top of the first compartment.

* * * * *